US007950541B2

(12) United States Patent
Holcomb et al.

(10) Patent No.: US 7,950,541 B2
(45) Date of Patent: May 31, 2011

(54) APPARATUS AND METHOD FOR MAGNETICALLY SEALING A BEVERAGE CONTAINER LID

(75) Inventors: David A. Holcomb, Seattle, WA (US); Jason O. Germany, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 554 days.

(21) Appl. No.: 11/482,543

(22) Filed: Jul. 7, 2006

(65) Prior Publication Data

US 2007/0012697 A1 Jan. 18, 2007

Related U.S. Application Data

(60) Provisional application No. 60/697,894, filed on Jul. 7, 2005, provisional application No. 60/711,797, filed on Aug. 26, 2005, provisional application No. 60/725,935, filed on Oct. 11, 2005.

(51) Int. Cl.
*B65D 51/16* (2006.01)

(52) U.S. Cl. ..... 220/203.21; 220/230; 220/714

(58) Field of Classification Search ..... 220/203.21, 220/254.9, 714, 254.1, 230, 345.1, 345.2, 220/349, 345.4; 251/65; 206/818; 137/909; 292/251.5; 335/285
See application file for complete search history.

(56) References Cited

U.S. PATENT DOCUMENTS

| | | | | |
|---|---|---|---|---|
| 2,672,257 | A | 3/1954 | Simmonds | |
| 3,609,425 | A * | 9/1971 | Sheridan | 310/103 |
| 4,261,485 | A * | 4/1981 | Borg | 222/500 |
| 5,052,429 | A * | 10/1991 | Yoo | 137/38 |
| 5,280,806 | A * | 1/1994 | Glazebrook | 137/517 |
| 5,347,253 | A * | 9/1994 | Ogikubo | 335/302 |
| 5,462,189 | A * | 10/1995 | Pierce | 220/815 |
| 5,549,130 | A * | 8/1996 | Schuster | 137/39 |
| 6,070,763 | A * | 6/2000 | Gueret | 222/95 |
| 2001/0054564 | A1 * | 12/2001 | Bethune et al. | 206/459.5 |
| 2002/0179637 | A1 | 12/2002 | Doron et al. | |
| 2003/0132276 | A1 | 7/2003 | Metzler et al. | |

FOREIGN PATENT DOCUMENTS

FR 2623166 A1 5/1989

* cited by examiner

*Primary Examiner* — Anthony Stashick
*Assistant Examiner* — Jeffrey Allen
(74) *Attorney, Agent, or Firm* — Seed IP Law Group PLLC

(57) ABSTRACT

An apparatus for magnetically sealing a cover of a beverage container comprises a body having an opening, at least a first magnetic member of a first polarity disposed on at least a first portion of the body and a second magnetic member of a second polarity, substantially opposite the first polarity, disposed on at least a second portion of the body, the first magnetic member magnetically retaining the second magnetic member in first and second positions, independent of mechanical assistance, to expose at least a portion of the opening to allow fluid flow to and from the container when in the first position and sealingly occlude the opening to prevent spillage when in the second position.

13 Claims, 7 Drawing Sheets

APPARATUS AND METHOD FOR MAGNETICALLY SEALING A BEVERAGE CONTAINER LID

CROSS-REFERENCE(S) TO RELATED APPLICATIONS

This application claims the benefit under 35 U.S.C. §119 (e) of U.S. Provisional Patent Application No. 60/697,894 filed Jul. 7, 2005; U.S. Provisional Patent Application No. 60/711,797 filed Aug. 26, 2005; and U.S. Provisional Patent Application No. 60/725,935 filed Oct. 11, 2005, where these (three) provisional applications are incorporated herein by reference in their entireties.

BACKGROUND OF THE INVENTION

1. Field of the Invention

The present invention is generally related to container lids, and more particularly, to apparatus and methods for sealing beverage containers, for example lids for portable coffee mugs.

2. Description of the Related Art

Modern-day lifestyles are increasingly mobile, especially in urban communities. Individuals are often on the go regardless of financial status, marital status, sex, and parental status. Since such individuals are typically stretched for time, they typically accomplish certain tasks while they are in route between activities, errands and avocations and/or while they are attending to their activities, errands and/or avocations. This trend has led to products designed to suit such lifestyles.

One example of a category of tasks that contemporary individuals accomplish while in route or during their activities is mobile communications. Another category is replenishments and consumables, for example, drinking beverages and eating foods in portable containers in the car, at work, during sports activities or other activities. In particular, beverages, such as coffee, tea and sports drinks are often consumed on the go. For example, often individuals either buy or make their beverages to take with them so they can consume their beverage wherever, for example, in a vehicle, in a meeting, during sports activities, or any other place where traditional beverage containers such as ceramic mugs or glass cups are not suitable due to the user being in motion or having limited capabilities to handle and/or manipulate the beverage container.

Existing solutions include disposable cups with plastic lids having an opening. However, these cups contribute to environmental pollution and do not sufficiently retain contents of the cup. For example, typically when the cup is full, if a user drops the cup or aggressively manipulates the cup while driving, the plastic lid is generally not structurally capable of retaining the contents, which consequently spill. Other solutions include reusable cups with sealable lids having an opening and that are sealed either threadedly or via mating surfaces of the lid and the container. Lids of many such cups may include a removable member to block the opening in the lid when the user is not drinking. However, many such members compromise partial spillage for removability and do not substantially prevent spillage, especially when the cup is aggressively handled or dropped, such as during driving or sports activities. Yet other solutions include removable members that may substantially seal the opening in the lid and prevent spillage; however, these lids typically include sealing devices that are difficult and time consuming to open and close, such as rubber or threadedly engaged seals.

Accordingly there is a need for an apparatus and a method to seal containers that is easy to manufacture, substantially prevents spillage and is selectively and rapidly manipulable between sealed and open positions.

BRIEF SUMMARY OF THE INVENTION

According to one embodiment, an apparatus used with a container for manually sealing or unsealing the container, comprises a body being sealingly engageable with the container, the body having an opening therein adapted to be in fluid communication with the container, and a magnetic closure coupled to the body and having at least one magnetically motivated member selectively and magnetically positionable in at least first and second positions on the body, the magnetically motivated member exposing at least a portion of the opening to allow the fluid communication when in the first position and sealingly occluding the opening to prevent the fluid communication when in the second position.

According to another embodiment, a container comprises a lid having an opening adapted to be in fluid communication with the container, and means for magnetically retaining a magnetically motivated member, independent of mechanical assistance, in at least first and second positions disposed on the lid, the magnetically motivated member exposing at least a portion of the opening to allow the fluid communication when in the first position and sealingly occluding the opening to prevent the fluid communication when in the second position.

According to yet another embodiment, a container lid comprises an opening, at least a first magnetic member of a first polarity disposed on at least a first portion of the lid and a second magnetic member of a second polarity, substantially opposite the first polarity, disposed on at least a second portion of the lid, the first magnetic member magnetically retaining the second magnetic member in first and second positions, independent of mechanical assistance, to expose at least a portion of the opening to allow fluid communication between the opening and the container when in the first position and sealingly occlude the opening to prevent spillage when in the second position.

According to still another embodiment, a method for sealing a lid of a container comprises magnetically attracting a first magnetic member of a first polarity toward a first portion of a second magnetic member of a second polarity proximate an opening in the lid to substantially occlude the opening and prevent spillage from the container, and retaining the first magnetic member on the opening independent of mechanical assistance.

BRIEF DESCRIPTION OF THE SEVERAL VIEWS OF THE DRAWING(S)

DETAILED DESCRIPTION OF THE INVENTION

The following detailed description is directed toward apparatus and methods for covering a beverage container. Illustrated and described embodiments of the present invention allow an individual to selectively seal the beverage container to prevent liquid from spilling therefrom, and unseal the beverage container to drink therefrom, both actions being accomplished by merely rolling a ball or similar member between respective locations on a cover for the beverage container. The following detailed description and associated figures are intended to provide an individual of ordinary skill in the art with enough information to enable the individual to make and use embodiments of the invention. Such an individual, however, having read this detailed description and reviewed the figures, will appreciate that modifications can be made from the illustrated and described embodiments without deviating from the spirit of the invention. It is the inventors' intention that all such modifications fall within the scope of the invention, to the extend any such deviation is within the scope of the associated claims.

Reference throughout this specification to "one embodiment" or "an embodiment" means that a particular feature, structure or characteristic described in connection with the embodiment is included in at least one embodiment of the disclosed methods and structures. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
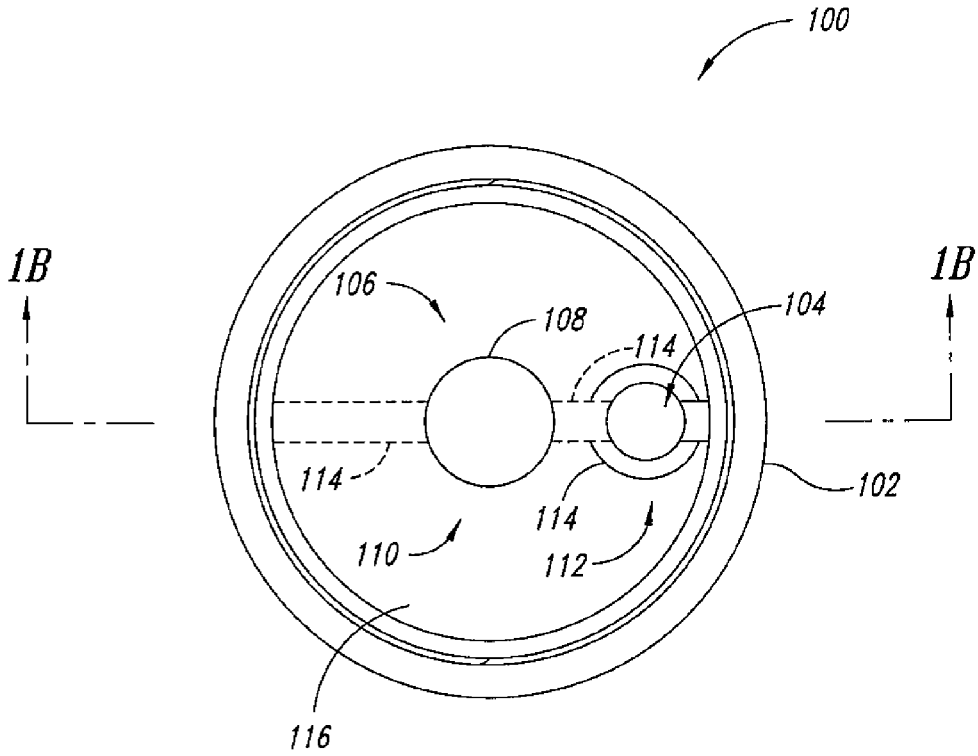
FIG. 1A is a top plan view of an apparatus for magnetically sealing a cover of a beverage container, according to one embodiment.

FIG. 1A illustrates an apparatus 100 for magnetically sealing a cover of a beverage container according to one particular embodiment, comprising a body 102 having an opening 104 adapted to communicate fluid flow to and from the container. The apparatus 100 further comprises a magnetic closure 106 having at least one magnetically motivated member 108 that may be selectively moved between first and second positions 110, 112, exposing at least a portion of the opening 104 when in the first position 110 and at least substantially occluding the opening 104 to magnetically seal the cover and prevent the fluid flow when in the second position 112.

The magnetic closure 106 may further comprise at least a first magnetic member 114 of a first polarity disposed on at least a portion of the body 102 and/or first and/or second surfaces 118, 120 (FIG. 1B) of an intermediate member 116 thereof. The magnetically motivated member 108 may comprise a second magnetic member of a second polarity, opposite the first polarity, or a magnetically attracted metallic material, such as for example, steel, nickel or any other ferromagnetic metal or material attracted to the first magnetic member 114. A user may apply a slight force to the magnetically motivated member 108, selectively moving it between the first and second positions 110, 112, respectively. As the magnetically motivated member 108 moves toward the first position 110, the first magnetic member 114 magnetically attracts the magnetically motivated member 108, maintaining the magnetically motivated member 108 in the first position 110 without manual and/or mechanical assistance and exposing at least a portion of the opening 104 to allow fluid flow. As the magnetically motivated member 108 moves toward the second position 112, the second magnetic member 114 magnetically attracts the magnetically motivated member 108, maintaining the magnetically motivated member 108 in the second position 112, without manual and/or mechanical assistance, to sealingly occlude the opening 104.

Figure 1B:
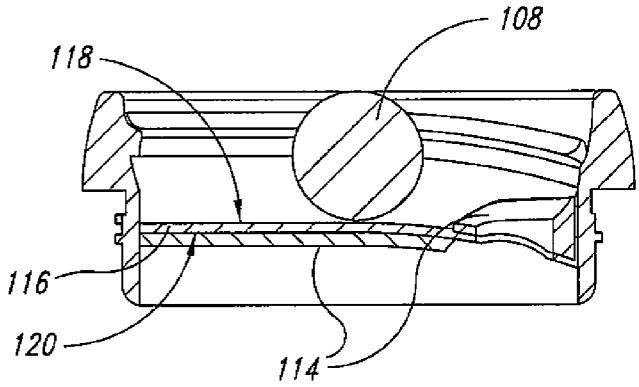
FIG. 1B is a cross-sectional view of the apparatus of FIG. 1A, viewed across section 1B-1B.

As illustrated in FIG. 1B, the magnetically motivated member 108 may be disposed on a first surface 118 of the intermediate member 116 and the first magnetic member 114 may disposed on the first and/or second surfaces 118, 120 of the intermediate member 116. The intermediate member 116, or at least one of the first and second surfaces 118, 120 thereof, may comprise a dimension and/or a material that allows the first magnetic member 114 to magnetically interact with the magnetically motivated member 108. For example, the intermediate member 116 may comprise plastics, silicone, elastics, films or foils, or any other suitable material that allows the first magnetic member 114 to magnetically interact with the magnetically motivated member 108.

Figure 2A:
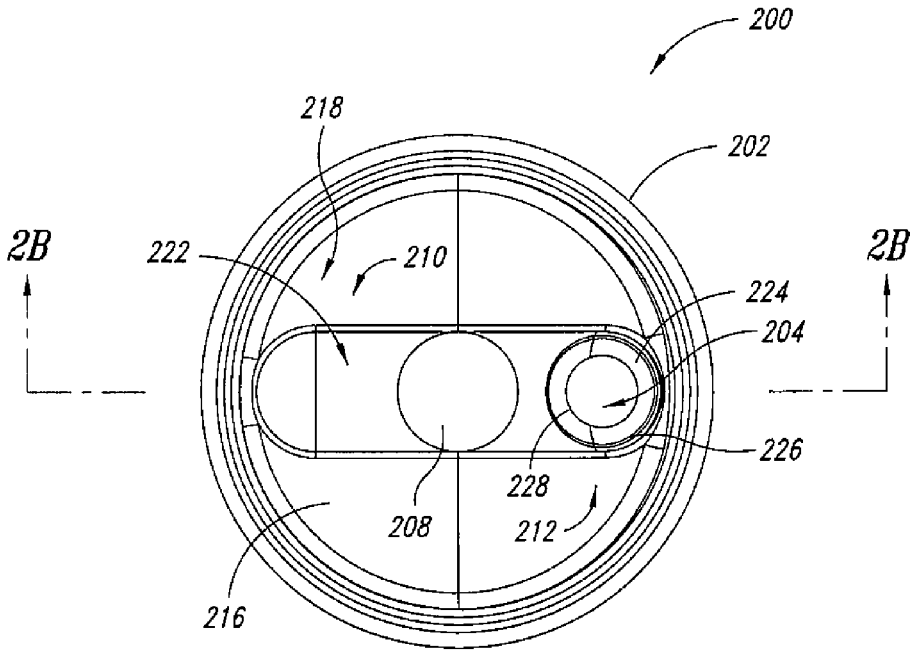
FIG. 2A is a top plan view of an apparatus for magnetically sealing a cover of a beverage container, according to another embodiment.
Figure 2B:
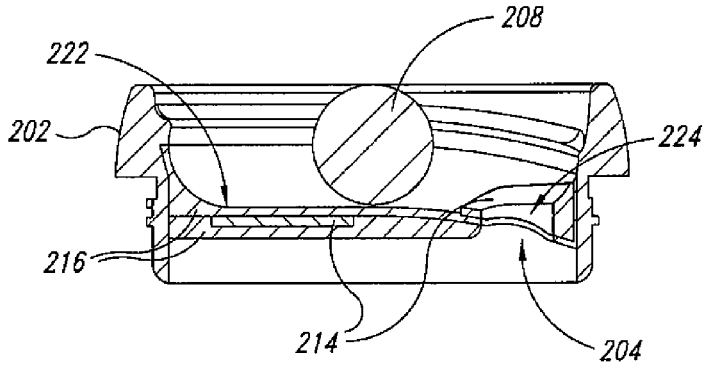
FIG. 2B is a cross-sectional view of the apparatus of FIG. 2A, viewed across section 2B-2B.

As illustrated in FIGS. 2A and 2B, in another embodiment, an apparatus 200 for magnetically sealing a cover of a beverage container may comprise a first recess 222 (see FIG. 4A), such as for example a concavity formed in at least a portion of the first surface 218 of the intermediate member 216 of the body 202 of the apparatus 200. The first recess 222 can approximately conform to a shape of at least a portion of the magnetically motivated member 208, guiding the magnetically motivated member 208 between the first and second positions 210, 212, further promoting the efficient movement of the magnetically motivated member 208 and making it easier and less time-consuming for the user to switch between the first and second positions 210, 212. In some embodiments, the first recess 222 may extend from the first position 210 to the second position 212. In some embodiments, the first recess 222 may comprise an optional second recess 224 formed in a portion of the first recess 222 and at least partially circumscribing the opening 204 proximate the second position 212. An upper portion of the recess 224 can project inwardly, preventing the magnetically motivated member 208 from being separated from the cover, while providing sufficient access to the magnetically motivated member 208 to allow a user to roll the magnetically motivated member 208 with, for example, a thumb, between the open and sealed configurations.

In some embodiments, the second recess 224 may comprises a frustoconical shape having a first terminal end 226 open to the recess 222 and/or the first surface 218 of the intermediate member 216 of the body 202, and a second terminal end 228 open to the opening 204. In still other embodiments, the second recess 224 may form and/or be the opening 204.

Figure 4A:
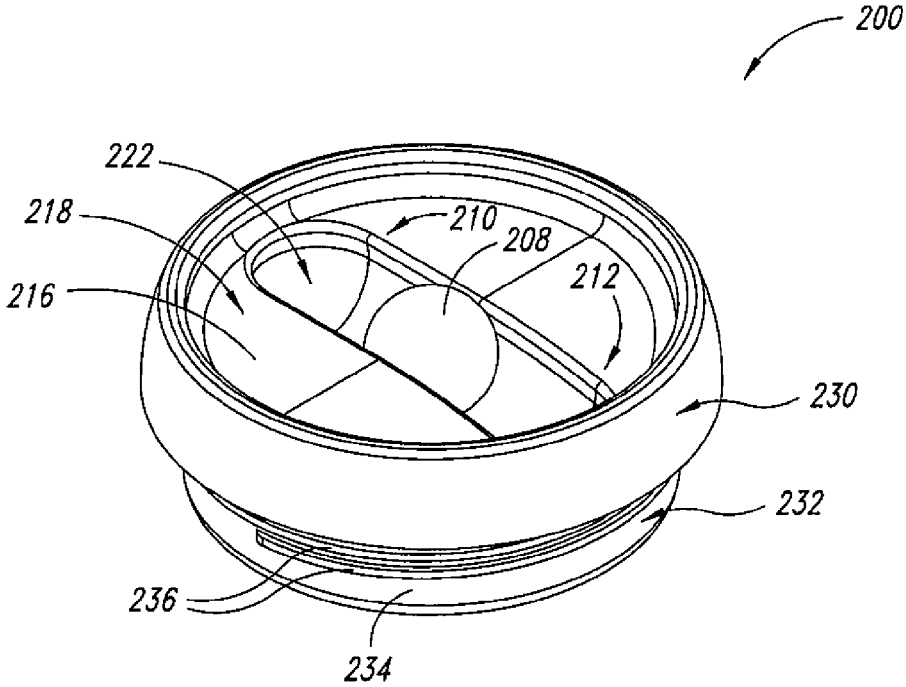
FIG. 4A is an isometric view of the apparatus of FIG. 2A.

In any of the embodiments, the magnetically motivated member 208 may comprise any shape that may have aesthetic and/or functional quality. For example, the magnetically motivated member 208 may comprise a spherical shape as shown in FIG. 2A and FIG. 4A, where the magnetically motivated member 208 rollingly and/or slidably moves between the first and second positions 210, 212. As illustrated in FIG. 2B, in some embodiments, at least a portion of the first magnetic member 214 can be disposed within a molding that may form the intermediate member 216.

Figure 3:
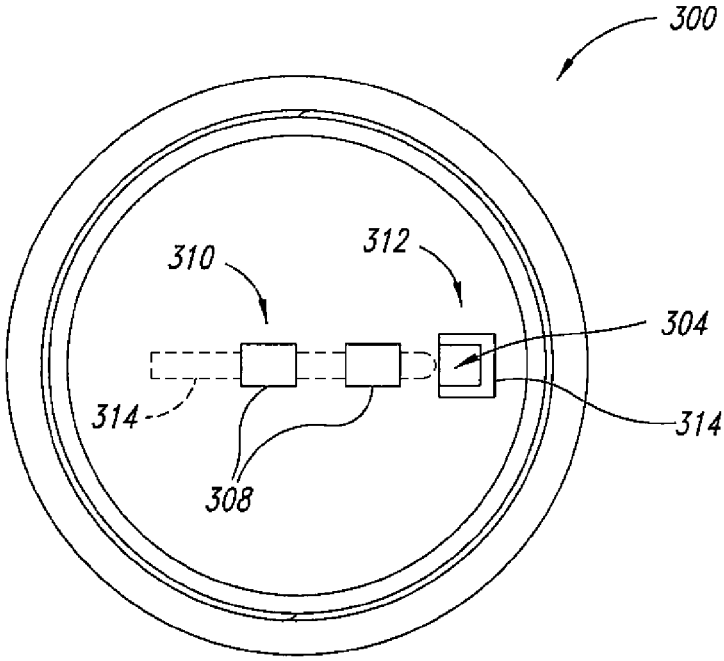
FIG. 3 is a top plan view of an apparatus for magnetically sealing a cover of a beverage container, according to yet another embodiment.

In yet another embodiment, illustrated in FIG. 3, an apparatus 300 for magnetically sealing a cover of a beverage container may comprise a magnetically motivated member 308 having a parallelogram and/or rectangular shape, where the magnetically motivated member 308 slidably translates between the first and second positions 310, 312 to at least partially expose and sealingly occlude an opening 304, respectively. At least one magnetic member 314 can retain the magnetically motivated member in the first and second positions 310, 312, without any manual and/or mechanical assistance.

The magnetically motivated member 108, 208, 308 may have any other shape, such as elliptical, cylindrical, frustoconical or any combination thereof or any other suitable shape. In some embodiments, the apparatus 300 may comprise more than one magnetically motivated member 308, which can have a consistent same shape and/or material, or they may comprise different shapes and/or materials.

As illustrated in FIG. 4A, the apparatus 200, discussed above, may comprise an optional first portion 230, extending in a first direction from the intermediate member 216 of the body 202 and adapted to deliver the fluid flow when the magnetically motivated member 208 is in the first position 210. Furthermore, the apparatus 200 may comprise a second portion 232, extending in a second direction, opposite the first direction, and adapted to form a fluid-tight seal with the container 40 (FIG. 4B) about its periphery 234, the intermediate member 216 being interposed between the first and second portions 232, 234. For example, the second portion 234 may comprise at least one protrusion 236 extending about at least a portion of the periphery 234. For example, in some embodiments the protrusions 236 may extend at an angle with respect to an axis substantially parallel to a plane that can be substantially normal to a longitudinal extension of the container 40. Accordingly, the protrusions 236 may threadedly engage at least a portion of the container 40 adjacent the periphery 234 and having at least one recess threadedly receiving the protrusions 236 to form the fluid-tight seal. Additionally, or alternatively, the protrusions 236 may comprise a resilient material, such as for example, silicone and/or plastics, the portion of the container 40 captively receiving the periphery 234, forming an interference fit with the protrusions 236 to form the fluid-tight seal. In other embodiments forming the interference fit fluid-tight seal, the angle may be substantially 0 degrees.

Figure 4B:
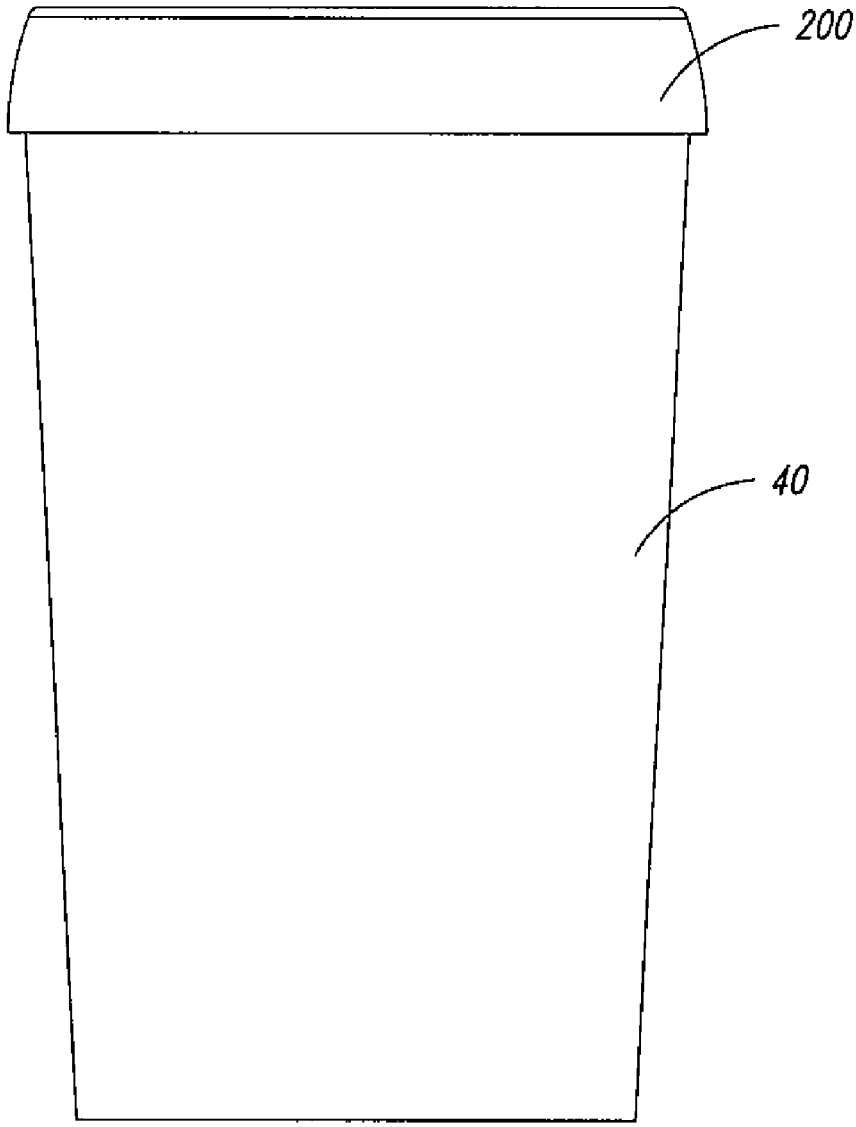
FIG. 4B is a side view of the apparatus of FIG. 4A engaged with a container.

The configuration of the periphery 234 and/or the protrusions 236 may be adapted to form the fluid-tight seal with existing containers, the user being able to use the apparatus 200 with various beverage containers, for example with standard small, medium large and/or short, tall, grande and/or vente configured cups and/or mugs. FIG. 4B illustrates the second portion 232 captively received in a portion of the container 40 adjacent the periphery 234 (FIG. 4A).

Figure 5A:
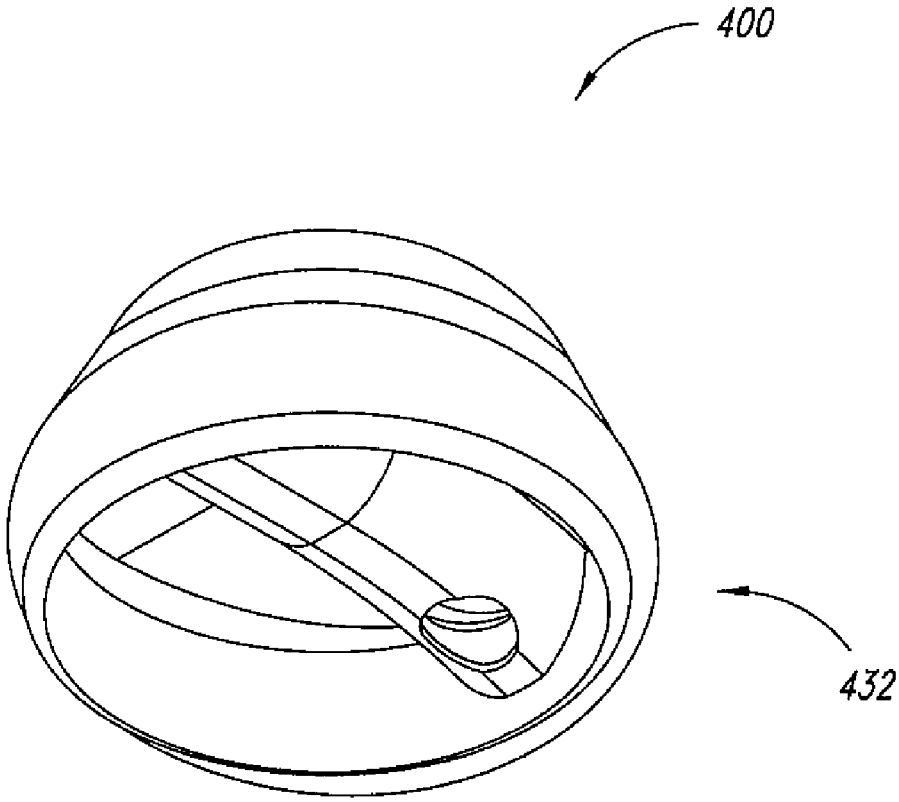
FIG. 5A is a bottom isometric view of an apparatus for magnetically sealing a cover of a beverage container according to still another embodiment.
Figure 5B:
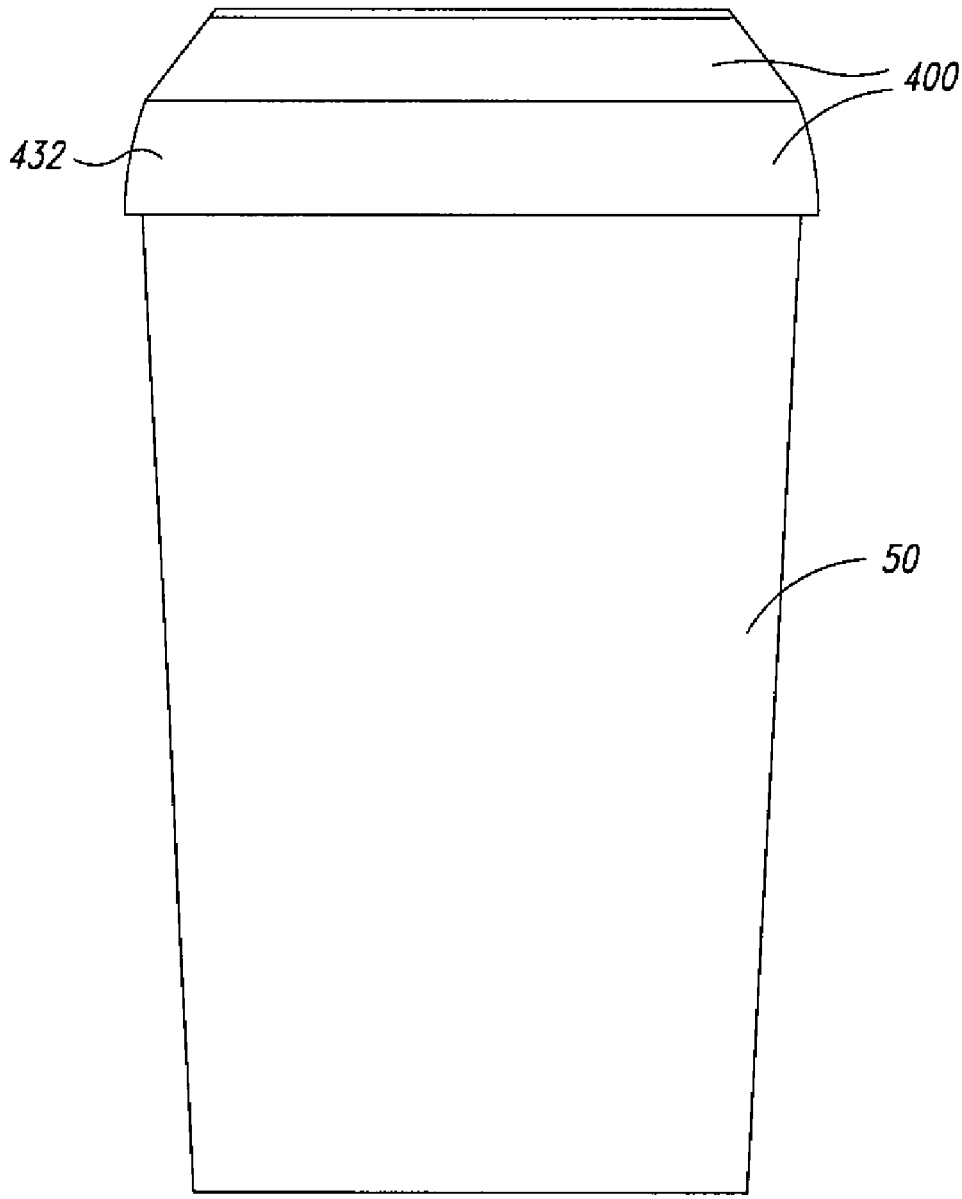
FIG. 5B is a side view of the apparatus of FIG. 5A engaged with a container.

As shown in FIG. 5A, still other embodiments of an apparatus 400 for magnetically sealing a cover of a beverage container 50 (FIG. 5B) may comprise a second portion 432 comprising a resilient, flexible, elastic and/or stretchable material such as silicone, flexible plastics, elastics and/or natural or synthetic rubbers and/or any combination thereof, to captively receive a periphery of an open end of the container 50 and form the fluid-tight seal.

Figure 6A:
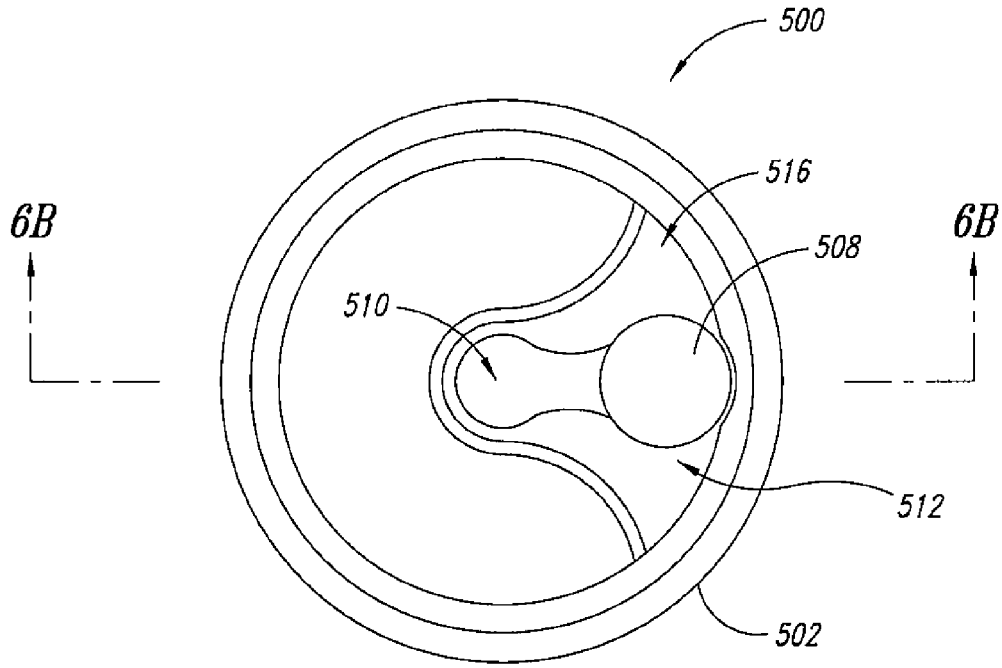
FIG. 6A is a top plan view of an apparatus for magnetically sealing a cover of a beverage container, according to a further embodiment.
Figure 6B:
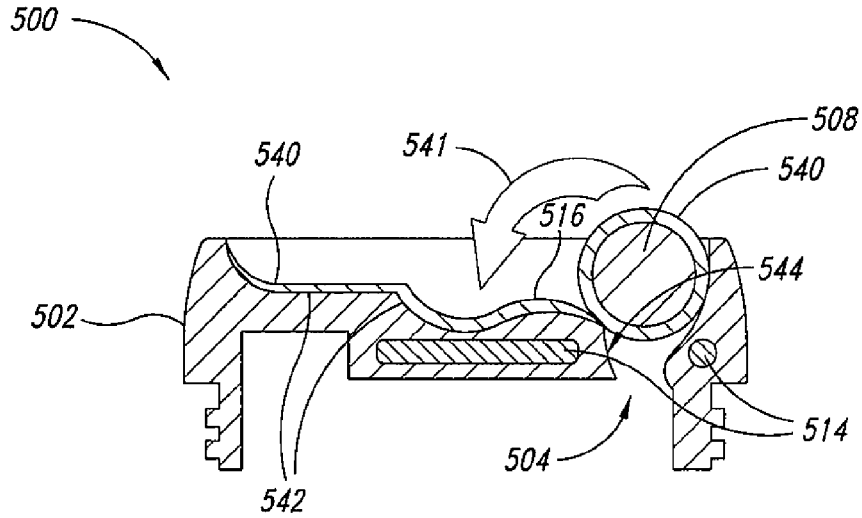
FIG. 6B is a cross-sectional view of the apparatus of FIG. 6A, viewed across section 6B-6B.

In a further embodiment as illustrated in FIG. 6, an apparatus 500 for magnetically sealing a cover of a beverage container may comprise a magnetically motivated member 508 magnetically engaged with at least a portion of the intermediate member 516 of the body 502 and selectively moveable, for example, rollable and/or slidable, between a first position 510 (FIG. 6B) in which the magnetically motivated member 508 is at least partially spaced apart from the opening 504, and a second position 512 (FIG. 6B) in which the magnetically motivated member 508 can be seated in at least a portion of the opening 504 to prevent fluids from passing through the opening 504. As shown in FIG. 6B, at least a portion of the intermediate member 516, the body 502 of the apparatus 500 and/or the magnetically motivated member 508 can be coated with a coating 540, for example with a slilicone and/or plastic overmold or other suitable coating, to facilitate the seal between the magnetically motivated member 508 and the opening 504, and/or to provide at least one feature 542, such as for example, contours, channels or other features to direct the magnetically motivated member 508 between the first and second positions 510, 512. The feature and/or features 542 can include a detent, depression, recess, curb, gutter, and/or any other feature that retains the magnetically motivated member 508 in the first position 510 without any manual and/or mechanical assistance, and/or facilitates a movement of the magnetically motivated member 508 between the first and second positions 510, 512.

The apparatus 500 may include at least a first magnetic member 514 having a concavity, recess, or opening to retain the magnetically motivated member 508 in both the first and second positions 510, 512, and/or multiple magnetic members 514, arranged throughout the body 502 to collectively retain the magnetically motivated member 508 in the first and second positions 510, 512. The opening 504 and/or the first magnetic member 514, which in some embodiments can form the opening 504, may comprise a cylindrical shape having a tapering periphery surface 544, such as a frustonical shape, to further facilitate preventing the magnetically motivated member 508 from passing through the opening 504 and/or the opening of the first magnetic member 514, into an interior of the container.

Although the apparatus 100, 200, 300, 400, 500 have been described primarily in conjunction with sealing a cover of a beverage container, one of ordinary skill in the art having reviewed this disclosure will appreciate the apparatus 100, 200, 300, 400, 500 can be used with any container storing and selectively dispensing fluids such as tea, coffee, soft drinks, sports drinks, bubble tea, frozen drinks and shakes, or any other liquid or fluid and solids, such as herbs, ground goods such as ground coffee, salt, pepper, or any other solids.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An apparatus for use with a drinking container for manually opening and closing the container, the apparatus comprising:

a body being sealingly engageable with the container, the body comprising a stationary magnet and having an opening therethrough adapted to allow fluid communication between an interior of the container and a surrounding environment, the opening being proximate at least a first portion of the stationary magnet, at least a second portion of the stationary magnet being spaced from the opening; and a metal ball magnetically attracted to the stationary magnet in the body and being selectively, manually movable with respect to the stationary magnet between at least a first position on the body in which the ball seals the opening and a second position on the body, spaced from the first position, in which the opening is unsealed to allow a user to drink from the container, the ball being selectively, manually rollable by the user between the first position and the second position along at least a portion of the body, the first portion of the stationary magnet retaining the ball in the first position and the second portion of the stationary magnet retaining the ball in the second position.

2. The apparatus of claim 1 wherein the body comprises a depression surrounding the opening to facilitate retention of the ball in the first position.

3. The apparatus of claim 1 wherein the body comprises a depression to facilitate retention of the ball in the second position.

4. The apparatus of claim 1 wherein the body comprises a first depression surrounding the opening to facilitate retention of the ball in the first position and a second depression to facilitate movement of the ball at least toward the second position.

5. The apparatus of claim 1 wherein the body comprises a first depression surrounding the opening to facilitate retention of the ball in the first position and a second depression to facilitate movement of the ball at least toward the second position, wherein the second depression is in the form of an elongated recess extending at least partially between a location of the ball in the first position and a location of the ball in the second position.

6. The apparatus of claim 1 wherein the body comprises an elongated depression to facilitate rolling the ball at least partially between the first position and the second position.

7. An apparatus for use with a drinking container for manually opening and closing the container, the apparatus comprising:

a body being sealingly engageable with the container, the body comprising a magnet and having an opening therethrough adapted to allow fluid communication between an interior of the container and a surrounding environment, a first portion of the magnet at least partially surrounding the opening, a second portion of the magnet being spaced from the opening; and a metal ball magnetically attracted to the magnet in the body and being selectively positionable in at least a first position on the body in which the ball seals the opening and a second position on the body, spaced from the first position, in which the opening is unsealed to allow a user to drink from the container, the ball being selectively rollable by the user between the first position and the second position along at least a portion of the body, the first portion of the magnet retaining the ball in the first position and the second portion of the magnet retaining the ball in the second position.

8. The apparatus of claim 7 wherein the first portion of the magnet entirely surrounds the opening.

9. The apparatus of claim 1 wherein the ball is spherical.

10. The apparatus of claim 1 wherein at least one of the body and the ball is overmolded with silicone.

11. The apparatus of claim 1 wherein the body comprises an elongated depression to facilitate rolling the ball between the first position and the second position, at least one wall of the elongated depression projecting above a base of the elongated depression by a distance sufficient to allow the ball to move therebetween, the wall preventing the ball from being separated from the apparatus.

12. The apparatus of claim 1 wherein the body comprises an elongated depression to facilitate rolling the ball between the first position and the second position, a pair of walls of the elongated depression projecting above a base of the elongated depression by a distance sufficient to allow the ball to move therebetween, a gap between the terminal ends of the projecting walls being sufficiently wide to allow a user to touch and move the ball between the first and second positions, while the walls preventing the ball from being separated from the apparatus.

13. A container comprising:

a body adapted to be carried by a user, and having an interior adapted to retain a liquid;

a lid being sealingly engageable with the container, the lid comprising a stationary magnet and having an opening therethrough adapted to allow fluid communication between the interior of the container and a surrounding environment, the opening being proximate at least a first portion of the stationary magnet, at least a second portion of the stationary magnet being spaced from the opening; and a metal ball magnetically attracted to the stationary magnet in the lid and being selectively positionable in at least a first position on the lid in which the ball seals the opening and a second position on the lid, spaced from the first position, in which the opening is unsealed to allow a user to pour liquid from the container, the ball being selectively rollable between the first position and the second position along at least a portion of the lid, the first portion of the stationary magnet retaining the ball in the first position and the second portion of the stationary magnet retaining the ball in the second position.

* * * * *